US006301860B1

(12) United States Patent
Gunderman et al.

(10) Patent No.: US 6,301,860 B1
(45) Date of Patent: Oct. 16, 2001

(54) LIQUID PRODUCT SAMPLER PACKAGE WITH FRAME STRUCTURE FOR ENHANCED BURST STRENGTH

(75) Inventors: Anthony J. Gunderman; Catholyn T. Griffiths, both of Phoenix, MD (US)

(73) Assignee: Color Prelude, Inc., Baltimore, MD (US)

( * ) Notice: Subject to any disclaimer, the term of this patent is extended or adjusted under 35 U.S.C. 154(b) by 0 days.

(21) Appl. No.: 09/382,661

(22) Filed: Aug. 25, 1999

(51) Int. Cl.[7] ..... B65B 61/00

(52) U.S. Cl. ..... 53/410; 53/128.1; 206/581; 206/484; 206/461

(58) Field of Search ..... 206/581, 484, 206/461, 463, 734; 53/410, 128.1

(56) References Cited

U.S. PATENT DOCUMENTS

| | | | | |
|---|---|---|---|---|
| 4,037,716 | * | 7/1977 | Marks . | |
| 4,220,244 | * | 9/1980 | Elmore . | |
| 4,234,084 | * | 11/1980 | Hutten . | |
| 4,787,380 | * | 11/1988 | Scott . | |
| 4,805,773 | * | 2/1989 | Sabongi . | |
| 4,844,246 | * | 7/1989 | Harrison et al. . | |
| 4,941,574 | | 7/1990 | Meehan | 206/466 |
| 5,105,941 | | 4/1992 | Dolan et al. | 206/232 |
| 5,257,692 | * | 11/1993 | Heacox . | |
| 5,295,580 | | 3/1994 | Hicks | 206/588 |
| 5,439,100 | * | 8/1995 | Gordon et al. . | |
| 5,535,885 | | 7/1996 | Daniel et al. | 206/484 |
| 5,622,263 | | 4/1997 | Greenland | 206/581 |
| 5,704,481 | * | 1/1998 | Lutz . | |
| 5,799,675 | | 9/1998 | Gunderman et al. | 132/333 |
| 5,879,769 | | 9/1999 | Greenland et al. | 428/35.7 |
| 5,944,188 | * | 8/1999 | Grosskopf et al. . | |
| 6,085,904 | * | 7/2000 | Perdue, Jr. . | |

* cited by examiner

*Primary Examiner*—Eugene Kim
(74) *Attorney, Agent, or Firm*—Ostrolenk, Faber, Gerb & Soffen, LLP

(57) ABSTRACT

A product sampler package for insertion or binding into a periodical, catalog, brochure, or other literature includes a composite carrier card formed by affixing a planar support frame to a bottom carrier sheet of the carrier card to thereby form a shallow well, and a top carrier sheet of the composite carrier card affixed to the bottom carrier sheet and covering the support frame. The top carrier sheet may have an opening positioned over the well so as to be surrounded by the support frame. The package is completed by affixing a product sampler unit containing a sample of a fluid or volatile personal care product on top of the composite carrier card. Packaged in this manner, the support frame enhances the burst strength of the sampler unit by absorbing compressive forces exerted across the plane of the sampler. The support frame is preferably made of an N-flute corrugated cardboard and is shaped to define an enclosed space in its center, while the sampler unit is formed by hermetically sealing together a cover film and backing film to form a pouch or compartment. Preferably, at least the cover film is transparent or translucent so that the product sample can be viewed through the package without opening the sampler unit. Longevity of the fluid product sample is ensured by incorporating barrier layers in each of the cover and backing films which have a moisture vapor transmission rate similar to that of foil.

37 Claims, 13 Drawing Sheets

LIQUID PRODUCT SAMPLER PACKAGE WITH FRAME STRUCTURE FOR ENHANCED BURST STRENGTH

BACKGROUND OF THE INVENTION

1. Field of the Invention

The present invention relates to a fluid product sampler package for insertion in magazines, catalogs, and periodicals delivered to consumers through the mail system.

2. Description of the Related Art

Manufacturers of cosmetics, toiletries, beauty and skin-care products, etc. commonly promote their products by distributing free samples to current or potential consumers with the goal of building and/or maintaining customer loyalty for the products or product lines. Each sample is packaged in a disposable sampler unit which is generally sized to contain approximately one unit dose of the product in an attractive display having artwork or informational copy print printed thereon, and preferably has a transparent or translucent cover film. A sampler package having these aesthetic features will encourage the potential customer to sample the product and enable the consumer to view the actual product to thereby choose the preferred shade or color prior to opening the package.

One method of distributing such samples has been to distribute them to potential customers in a store in which the product is sold. A further reaching, more effective method has been to mail the samplers to a targeted audience through the U.S. Postal Service (USPS). Typically, the samplers are mailed as inserts in brochures, catalogs, magazines, or the like.

For distribution through the USPS, the samplers can be mailed either under a non-discounted rate classification or under a more economical periodical/subscription rate classification. To qualify for classification under the subscription rate, each sampler package must comply with certain guidelines set by the USPS. For example, certain of these guidelines specify that the unit must be firmly affixed to a carrier card or to a page of the periodical, and that the sampler must be designed to allow the product to be sampled while still in the periodical. Sampler packages for distribution as inserts must also be non-bulky and sufficiently flexible to avoid breakage in shipment or storage, yet rigid enough to facilitate high speed insertion into the carrier medium.

When the product to be sampled is a fluid and/or volatile composition such as a liquid, gel or paste, USPS regulations mandate that the sampler package must also be capable of withstanding the substantial compressional forces exerted on the samples when inserted in periodicals such as magazines or catalogs which are then stacked for storage or distribution.

In one type of prior art sampler package as disclosed in U.S. Pat. No. 5,535,885 to Daniel et al., a liquid fragrance sample is disposed in a container made of gelatin which is designed to distribute compressive forces away from the portion containing the sample so as to avoid rupture during shipment or storage. This container, however, provides thickened edges surrounding the sample-containing portion, and also concentrates the volume of the sample into a cylindrical central region. When the disclosed sampler package is placed as inserts in a stack of magazines or the like, the stack becomes cumulatively bulky due to the significant thickness of the disclosed sampler package, thus creating a "footballing" effect in the stack of magazines.

Cosmetic sampler packages formed as pouches from composite laminates are capable of containing a greater amount of product relative to the amount of packaging material while also being flexible and capable of retaining a much flatter shape when filled than the package disclosed in Daniel. With such packages, however, it is essential that the package have a burst strength sufficient to endure the oftentimes rigorous conditions of shipment, including extremely large amounts of pressure and weight potentially exerted on the sampler packages when stacked in magazines, etc.

Another sampler package disclosed in Meehan, U.S. Pat. No. 4,941,574, provides a sampler for a liquid product contained in a flexible envelope made from a film material. The sampler is protected from bursting by sandwiching the edges of the envelope between two layers of a rigid material having a combined thickness at least that of the envelope having the product contained therein. To sample the product, however, one must detach the envelope from the rigid layers, rather than simply opening and testing the product while still affixed in the package.

In view of the shortcomings of the prior art discussed above, it is therefore desirable to provide a sampler package designed for distribution as an insert in subscription rate periodical literature which has enhanced burst strength, allows a consumer to view the shade or texture of the product before opening the sampler, allows a consumer to test or sample the product with the sampler remaining affixed to the carrier medium, and which is substantially flat or non-bulky to avoid a cumulative "footballing" effect.

SUMMARY OF THE INVENTION

The present invention overcomes the deficiencies of the prior art noted above by providing a package for a product sampler containing a fluid or volatile product to be inserted in periodical literature in a manner which satisfies the requirements for subscription rate classification as set by the U.S. Postal Service.

The present invention also provides, a product sampler containing a fluid or volatile product which can be inserted in periodical literature such that the product can be tested or sampled with the sampler unit still affixed in the periodical.

The present invention further provides a package for a fluid product sampler which is relatively non-bulky so as to minimize any "footballing" effect when distributed as inserts in magazines or other periodicals which have been stacked on top of one another.

Further, the present invention provides a fluid product sampler which is packaged in such a manner that the burst strength of the sampler is considerably enhanced by the design of the package.

Still further, the present invention provides a package for presenting a product sampler and which is versatile in design so as to be capable of use with a variety of different types and shapes of sampler units.

The sampler package of the present invention includes a composite carrier card formed by affixing a planar support frame to a bottom carrier sheet of the carrier card to thereby form a shallow well, and a top carrier sheet of the composite carrier card affixed to the bottom carrier sheet and covering the support frame. A product sampler unit containing a sample of a fluid or volatile personal care product is positioned on the top carrier sheet and affixed to the composite carrier sheet so as to be substantially centered over the well.

If desired, the top carrier sheet may be formed with an opening aligned over the well so that the opening is surrounded by the support frame. In this case, the product sampler placed on the top carrier sheet covers the opening and is affixed to the bottom carrier sheet through the opening.

The assembled package is suitable for rapid insertion or binding into a periodical, catalog, brochure, or other literature. Presented in this manner, the product sampler allows the product contained therein to be tested while still on the page in the periodical, and is protected by the surrounding presence of the support frame to absorb compressive forces exerted across the plane of the sampler.

The support frame is preferably made of an N-type or other small fluted corrugated cardboard and has a closed shape, so as to define an enclosed space in its center. Alternatively, the support frame can constitute an open structure, but must be structured so that the sampler unit is supported by the support frame on at least two sides. The support frame is thus formed as part of the composite carrier card for the sampler unit to significantly enhance the burst strength of the otherwise unprotected sampler unit.

Furthermore, since the support frame is formed as part of the carrier card to which the sampler unit is affixed at the final stage of assembly of the package, the carrier card does not require that the sampler unit be made with the same shape or size with the support frame, and does not require that the sampler unit is precisely centered over the area enclosed by the support frame. Such versatility in the carrier card design allows the packages to be more efficiently produced for use with a wide variety of sampler units having many different shapes and sizes for sampling many different types of products.

The sampler unit is formed by hermetically sealing together a cover film and backing film to form a compartment or pouch. Preferably, at least the cover film is transparent or translucent so that the product sample can be viewed through the package without opening the same. Longevity of the fluid product sample is ensured by incorporating barrier layers in each of the cover and backing films which have a moisture vapor transmission rate similar to that of foil.

Other features and advantages of the present invention will become apparent from the following description of the invention which refers to the accompanying drawings.

DETAILED DESCRIPTION OF THE PREFERRED EMBODIMENTS

Figure 1A:
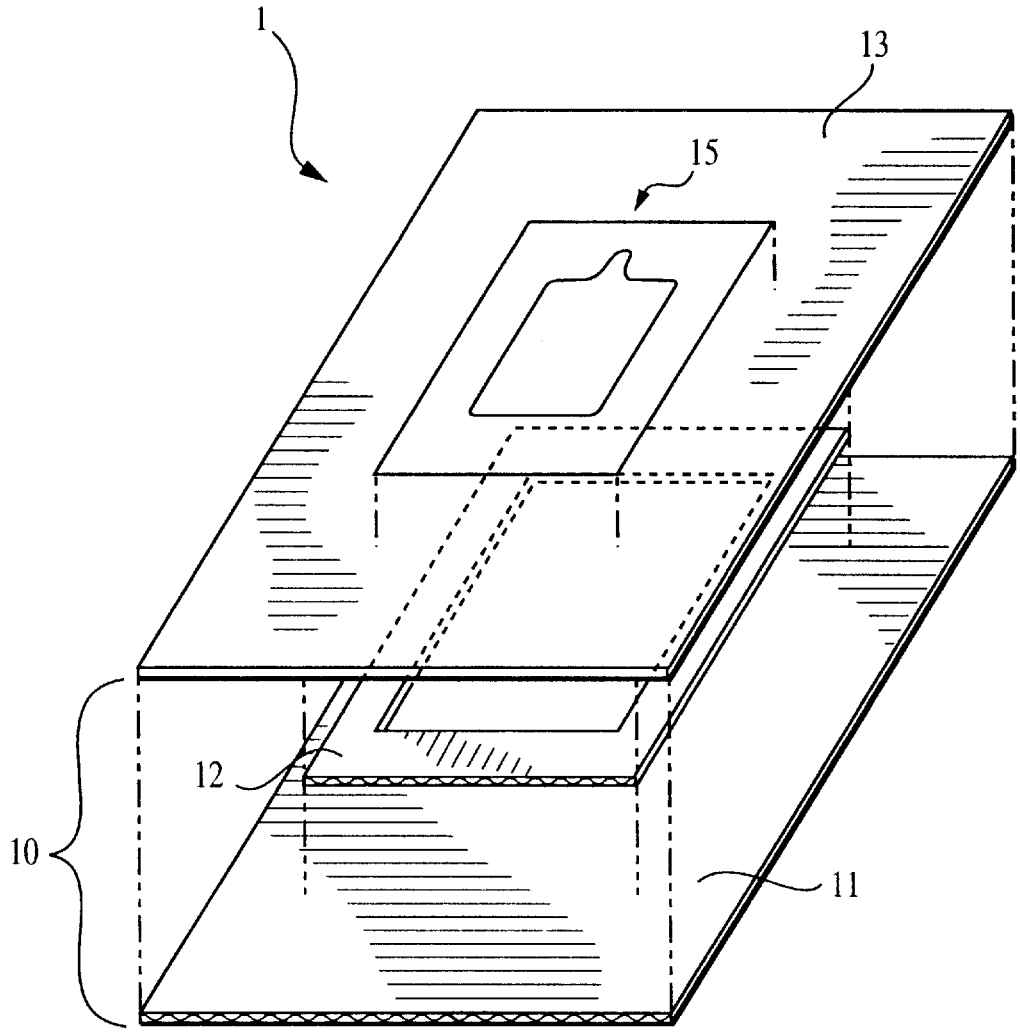
FIG. 1A shows an exploded view of a product sampler package in accordance with a preferred embodiment of the present invention.

An embodiment of the present invention will be described with reference to FIGS. 1A–5. A composite carrier card 10 for presenting a fluid product sampler as an insert in literature such as magazines, catalogs, and brochures is shown in exploded view in FIG. 1A. Composite carrier card 10 includes a bottom carrier sheet 11 having a support frame 12 affixed to the top surface thereof, and a top carrier sheet 13 covering support frame 12 and affixed to bottom carrier sheet 11.

Support frame 12 has a thickness so as to essentially form a shallow well 22 defined by the space enclosed or embraced by the shape of frame 12, with bottom sheet 11 forming the base of the well, for absorbing a majority of compressive forces exerted on the plane of the fluid sampler placed over the well.

Figure 1B:
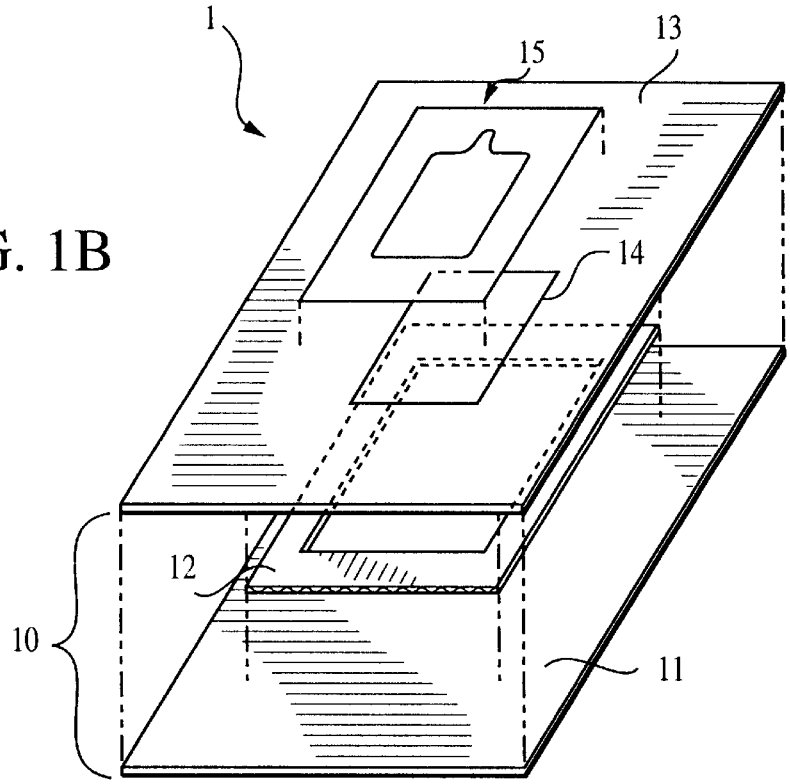
FIG. 1B shows an exploded view of a product sampler package in accordance with a variant of the preferred embodiment of the present invention.

If desired, top carrier sheet 13 can be formed with an opening 14 which is aligned so as to be disposed over the well 22, as shown in FIG. 1B. When provided, opening 14 is generally smaller than the planar area of well 22, but can have the same planar dimensions as well 22. In any case, opening 14 should not be larger than the inside periphery of well 22, whereby the support frame 12 would be exposed through opening 14 even if opening 14 is perfectly centered over the well.

Figure 2:
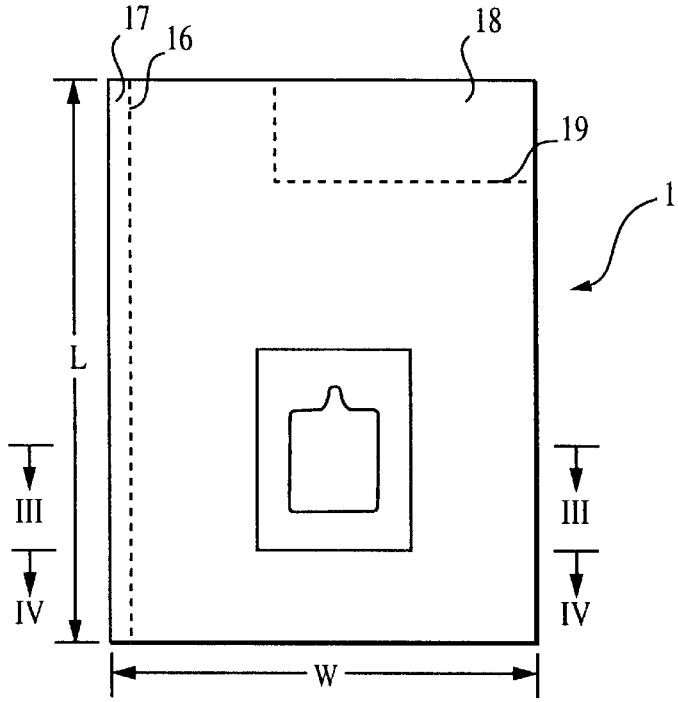
FIG. 2 shows a front view of the assembled package illustrated in FIGS. 1A and 1B.

A product sampler 15 is disposed on top of top carrier sheet 13, and is affixed to the composite carrier card so as to be substantially centered over the well. If top carrier sheet 13 is formed with an opening 14 as described above, the product sampler is affixed to bottom carrier sheet 11 through opening 14. Furthermore, the area covered by sampler unit 15 should generally be larger than the size of opening 14. An example of the assembled package 1 is shown in FIG. 2.

Figure 5:
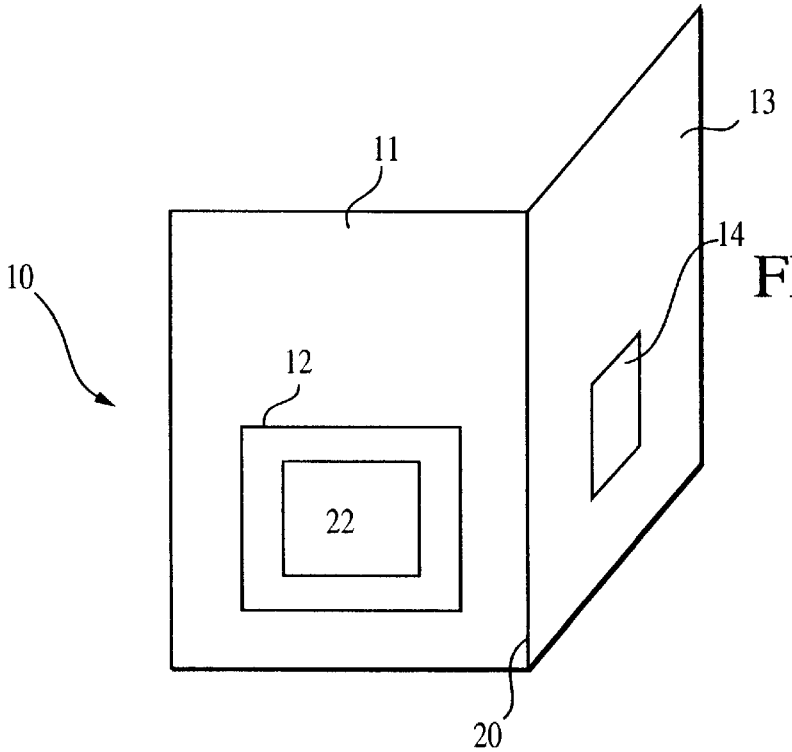
FIG. 5 shows a variant of the composite carrier card of the package shown in FIG. 1.

Top carrier sheet 13 and bottom carrier sheet 11 may be separate sheets as illustrated in FIGS. 1A and 1B, but are preferably provided as a single sheet which has been folded along a fold line 20 as shown in FIG. 5. Although fold line 20 is illustrated as forming the right edge of the composite carrier card 10 in FIG. 5, the carrier card 10 may be constructed so that fold line 20 extends along any edge of the carrier card. Optionally, fold line 20 may be perforated to facilitate detachment of a coupon region 18 as will be described later.

Bottom sheet 11 is suitably sized to be placed as an insert in a periodical, brochure, or the like. Specifically, bottom sheet 11 can be the same size as a page in such literature, or can be smaller according to preference.

Figure 7:
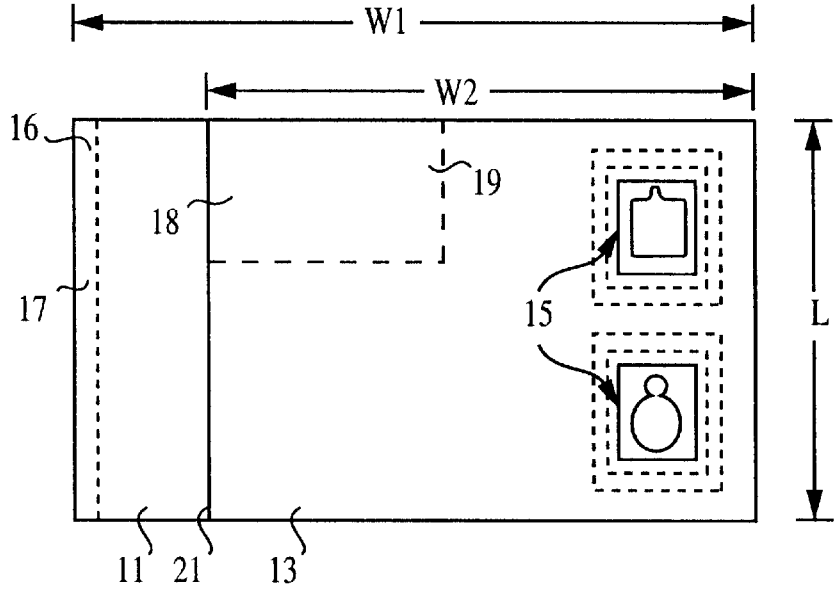
FIG. 7 shows another example of an assembled package in accordance with the present invention, including a plurality of product sampler units.
Figure 8:
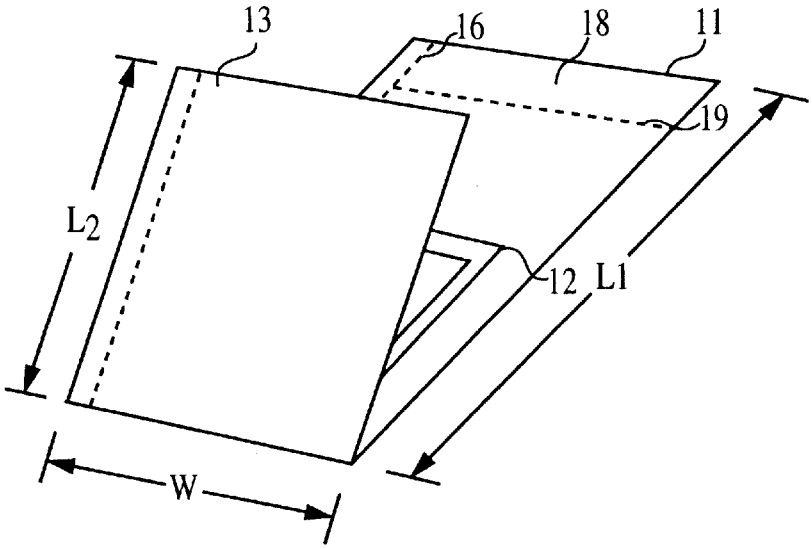
FIG. 8 shows another variant of a composite carrier card of the package in accordance with the present invention.

Top sheet 13 is preferably the same size as bottom sheet 11, but can also be cut to a size which is shorter than bottom sheet 11 in one of the length or width dimension. Even if top sheet 13 is smaller than bottom sheet 11, top sheet 13 should have substantially the same measurement as bottom sheet 11 in the other of the length or width dimension. For example, FIG. 7 shows the top sheet 13 as having the same length L as bottom sheet 11, but having a width W2 shorter than width W1 of bottom sheet 11. Similarly, FIG. 8 shows the top sheet 13 as having the same width W as bottom sheet 11, but having a length L2 approximately half the length L1 of bottom sheet 11.

As seen in FIG. 2, bottom sheet 11 (and also top sheet 13 if top sheet 13 has the same width W as bottom sheet 11) has a perforation 16 formed near the left edge of bottom sheet 11 and extending down the length L thereof. A slim margin 17 is thus defined between perforation 16 and the left edge for binding the package 1 into the pages of the magazine, catalog, brochure, etc., whereby a consumer can then easily separate the package 1 from the periodical by tearing along perforation 16. Optionally, perforation 16 may be omitted, whereupon the package 1 can be either loosely inserted in the carrier medium or bound into the carrier medium without a specifically provided means for detachment therefrom.

In the embodiment shown in FIG. 2, top sheet 13 is perforated along perforation 19 in an area which does not overlap support frame 12 to define a detachable coupon region 18. Copy print such as product or advertising information for the sampled product may be printed on both the front and/or back surfaces of the coupon region 18. To facilitate separation of the coupon region from the remainder of the top and bottom sheets for redemption upon purchase of the sampled product, fold line 20 may be perforated for easy tearing along the fold. Additionally, top sheet 13 and bottom sheet 11 should be adhered together in such a manner which renders the two sheets readily separable from each other at coupon region 18.

In the embodiment shown in FIG. 7, top sheet 13 has a shorter width than that of bottom sheet 11, thereby allowing top sheet to be lifted up along edge 21 to facilitate separation of the coupon region 18 from the bottom sheet 11. Alternatively, both the top and bottom sheets may be perforated to form coupon region 18 so that the detachable portion includes the two layers which have been securely adhered together at least in this region. In another variant of the invention, perforation 19 is formed solely on bottom sheet 11 to define coupon region 18, with bottom sheet 11 being separable from top sheet 13 at least in this region for detachment of the coupon.

If top sheet 13 is shorter than bottom sheet 11 in either the length or width dimension, as in the example shown in FIG. 8, then perforation 19 may be formed only in bottom sheet 11 to define coupon region 18.

As with coupon region 18, portions of the top and bottom sheets viewable by the consumer can be printed with instructions for accessing the product sample, illustrations, designs, and/or advertising and product information. With the exception of coupon region 18, top sheet 13 is preferably permanently sealed to bottom sheet 11 so as to be inseparable by the consumer without destruction of at least one of the layers, although it is possible to make the two layers separable to provide additional surfaces for printing product or advertisement information.

The material used to make top carrier sheet 13 and bottom carrier sheet 11 is preferably a sheet of thin paperboard, although other suitable materials may also be used, such as synthetic paper or a light plastic such as a polyethylene/calcium carbonate blend. The material selected to make the top and bottom sheets must be sufficiently rigid to facilitate insertion thereof by machines into periodical literature, brochures, etc. On the other hand, the material must be sufficiently flexible so as to be easily folded along fold line 20 and to be easily torn along perforation lines. Moreover, since the assembled package 1 is to be distributed as an insert page in a periodical, booklet or pamphlet, the carrier card material must therefore be sufficiently flexible and/or lightweight for this purpose.

As mentioned above, support frame 12 has a thickness to form a shallow well 22 defined by the space enclosed or embraced by the shape of frame 12, with bottom sheet 11 forming the base of the well, for absorbing a majority of compressive forces exerted on the plane of the fluid sampler placed over the well. On the other hand, the support frame is not so thick so as to inhibit flexibility upon turning the page containing the product sample in the periodical or literature in which package 10 is bound. Also, support frame 12 is sufficiently thin to avoid adding significant bulk to the periodical.

Preferably, support frame 12 is made from a corrugated cardboard having miniature-sized flutes, such as N-type corrugation flutes, for example. Nevertheless, support frame 12 may also be acceptably constructed using corrugated cardboard having any of the standard A through G type flutes. Other suitable materials for constructing the support frame include a plasticized foam or multiple layers of paper or other thin sheets including the material used for making the top and bottom carrier sheets. The front surface of support frame 12 is preferably provided in the same color as the background color of the top and/or bottom sheet, e.g., white, to minimize noticeability in the event that support frame 12 is misaligned with opening 14 during assembly of the package.

The size and shape of support frame 12 is such that a pouch or compartment portion of the sampler 15 containing a sample of a fluid product can be substantially centered over the well 22 defined by support frame 12 and bottom sheet 11. The product contained in the pouch or compartment is distributed across the entire area of the compartment, thus only slightly increasing the thickness of the sampler in the region of the pouch over the thickness of the materials forming the sampler unit.

Figure 3A:
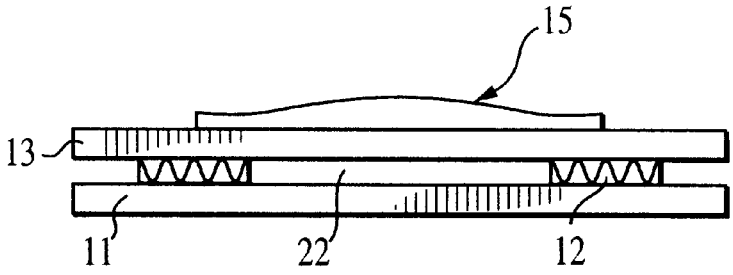
FIG. 3A shows a cross-section of the package cut along the line designated as III—III in FIG. 2 according to the embodiment shown in FIG. 1A when no force is exerted on the sampler package.
Figure 3B:
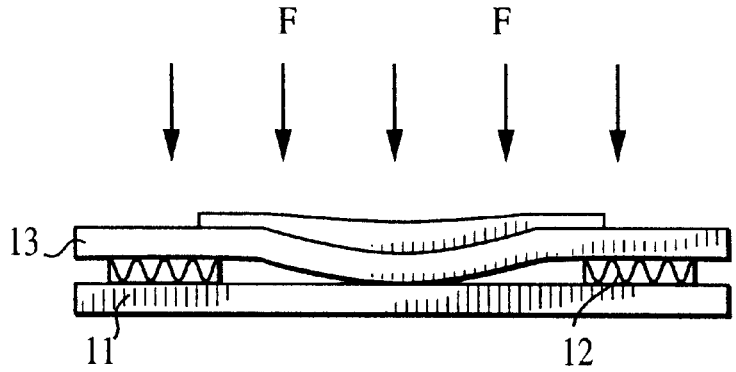
FIG. 3B shows a cross-section of the package cut along the line designated as III—III in FIG. 2 according to the embodiment shown in FIG. 1A when a force F is exerted on the sampler package.
Figure 3C:
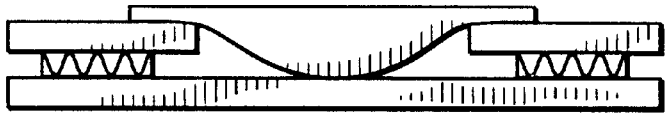
FIG. 3C shows a cross-section of the package cut along the line designated as III—III in FIG. 2 according to the embodiment shown in FIG. 1B when no force is exerted on the sampler package.
Figure 3D:
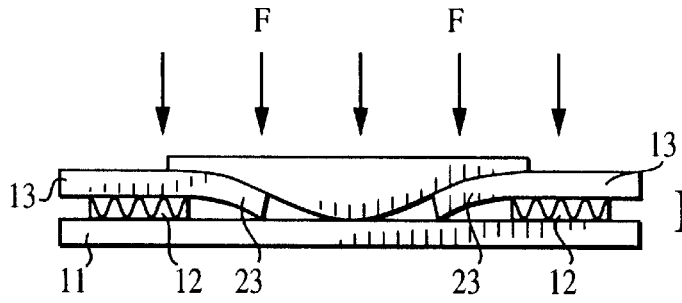
FIG. 3D shows a cross-section of the package cut along the line designated as III—III in FIG. 2 according to the embodiment shown in FIG. 1B when a force F is exerted on the sampler package.
Figure 4:
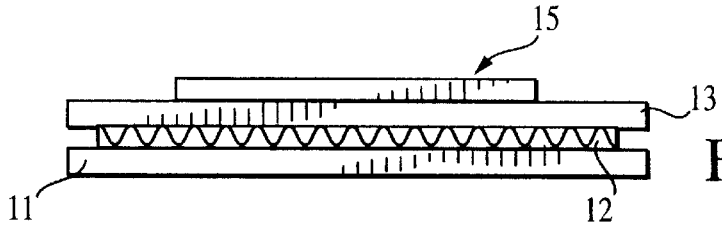
FIG. 4 shows a cross-section of the package cut along the line designated as IV—IV in FIG. 2.

When a heavy load is placed on top of the assembled package, the slight swelling of the sampler compartment is accommodated in the well 22 by pushing down into the well the region of the top carrier sheet 13 disposed over the well, as illustrated in FIGS. 3A–3B. In a sampler package of the present invention which provides an opening 14 in the top carrier sheet 13 over the well region 22, an application of force on the sampler forces the pouch to expand into the well 22 through opening 14 of the top sheet 13 by pushing down on regions 23 of top sheet 13 forming the periphery of opening 14 and which are disposed over the well, as illustrated in FIGS. 3C–3D. In this manner, a significant portion of the weight applied to the package is distributed to and absorbed by the support frame 12, thus supplementing the burst strength of the sampler unit 15.

In one test conducted on an assembled package with a fluid product sampler in accordance with the present invention, the samplers consistently demonstrated a burst strength upwards of 4000 lbs, and up to approximately 5000 lbs. Tested by itself, the fluid product samplers were found to be capable of sustaining loads between about 200 to 400 lbs before bursting.

Figure 10:
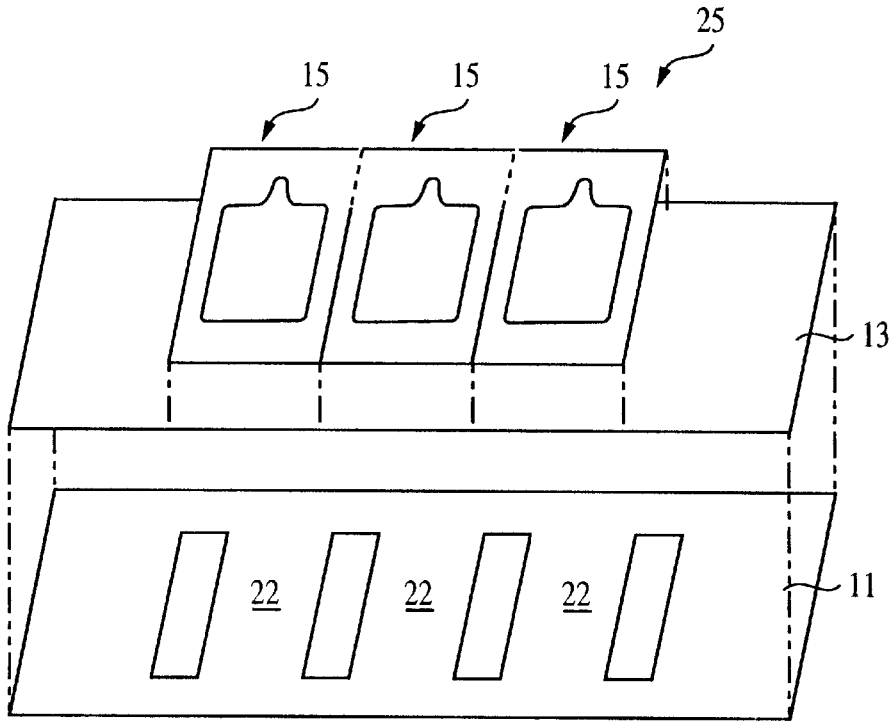
FIG. 10 shows another embodiment of a product sampler package having a plurality of sampler units in accordance with the present invention.

In the preferred embodiment, the support frame 12 forms an enclosed space, as exemplified in FIGS. 6A and 6D–6F, to provide a fully protective well around the product sample. Alternatively, the support frame may be acceptably formed as an open structure as shown in FIGS. 6B–6C and 6G–6H. At a minimum, at least two sides of the product sampler must be supported, as shown in FIG. 10. Other "shapes" in which the support frame may be formed in accordance with the present invention include a circles, oval, any type of polygon, or a structure providing support primarily at the "corners" of any of the described shapes, as illustrated FIGS. 6A–H.

Figure 6A:
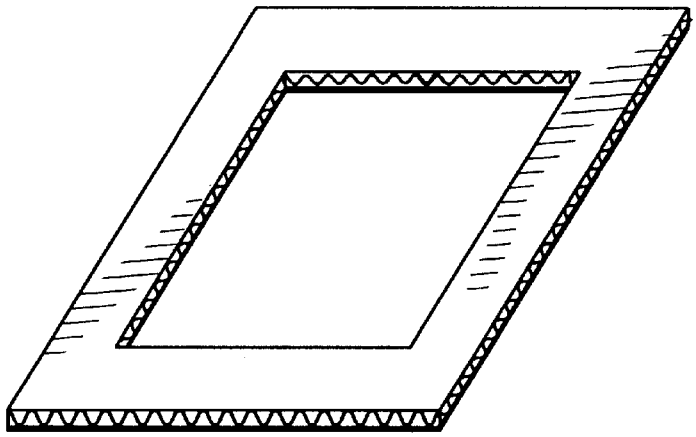
FIGS. 6A through 6H and 6J illustrate various embodiments of a support frame consistent with the package of the present invention.
Figure 6B:
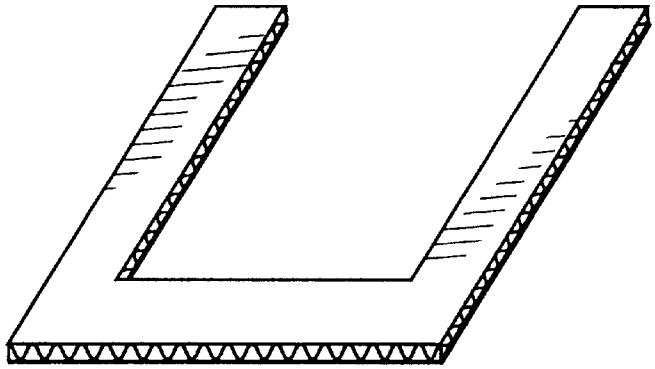
Figure 6C:
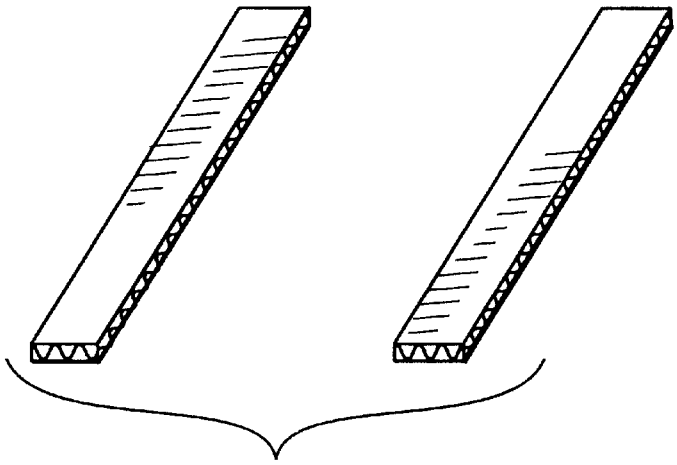
Figure 6D:
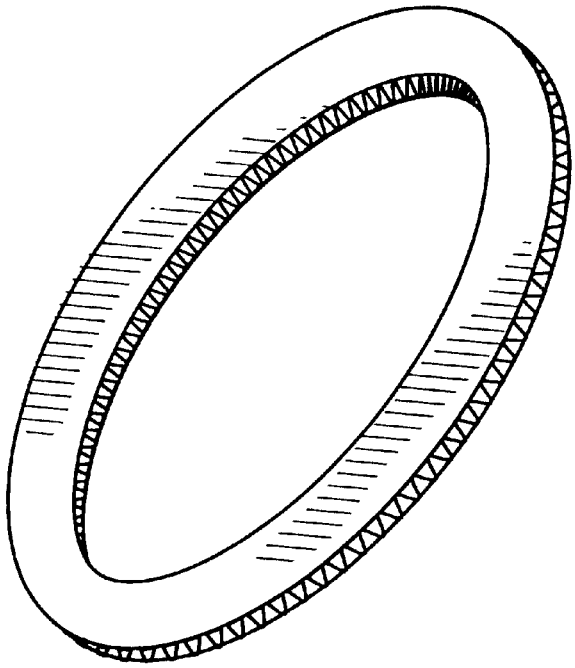
Figure 6E:
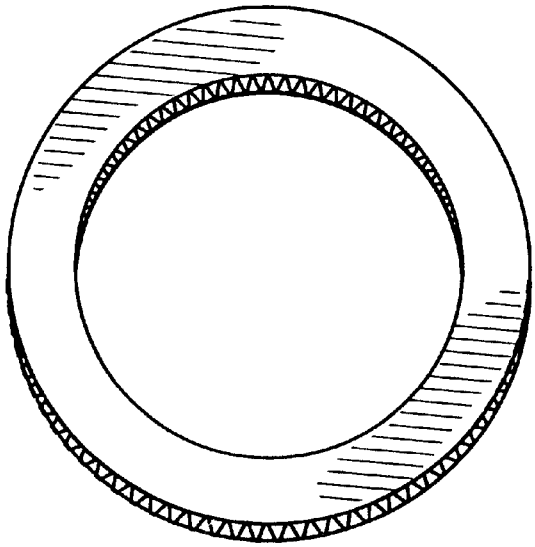
Figure 6F:
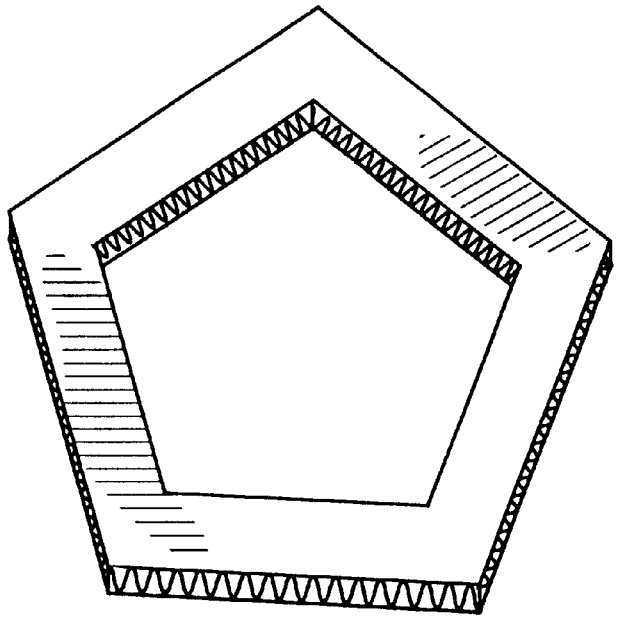
Figure 6G:
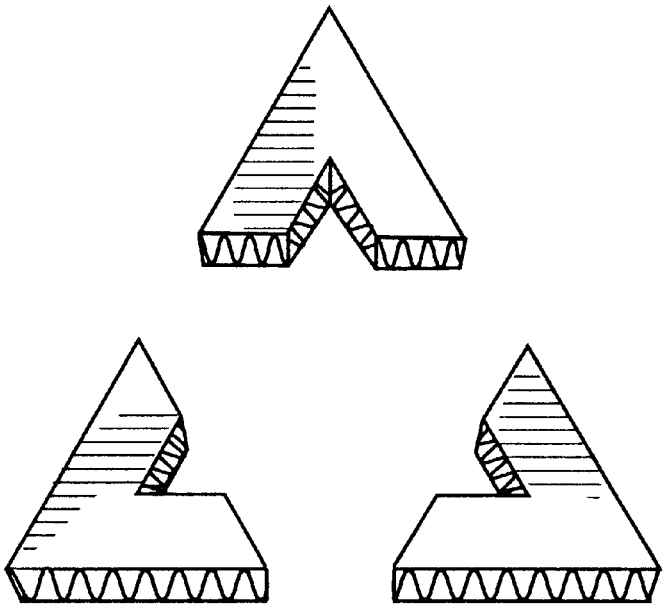
Figure 6H:
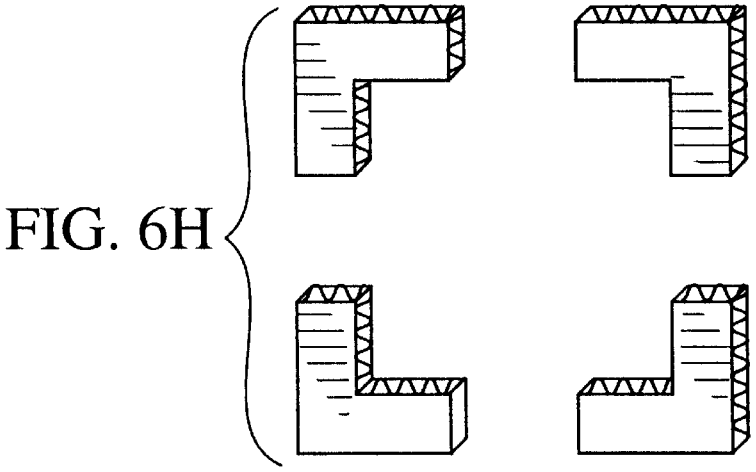
Figure 6J:
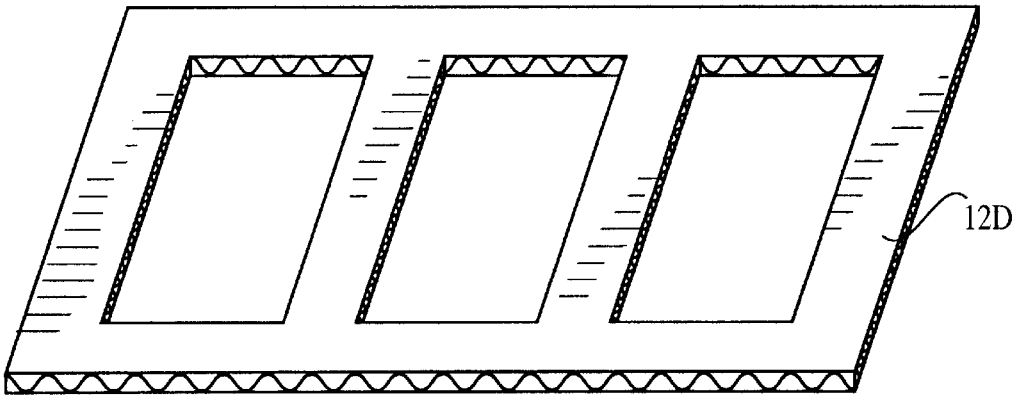
Figure 9:
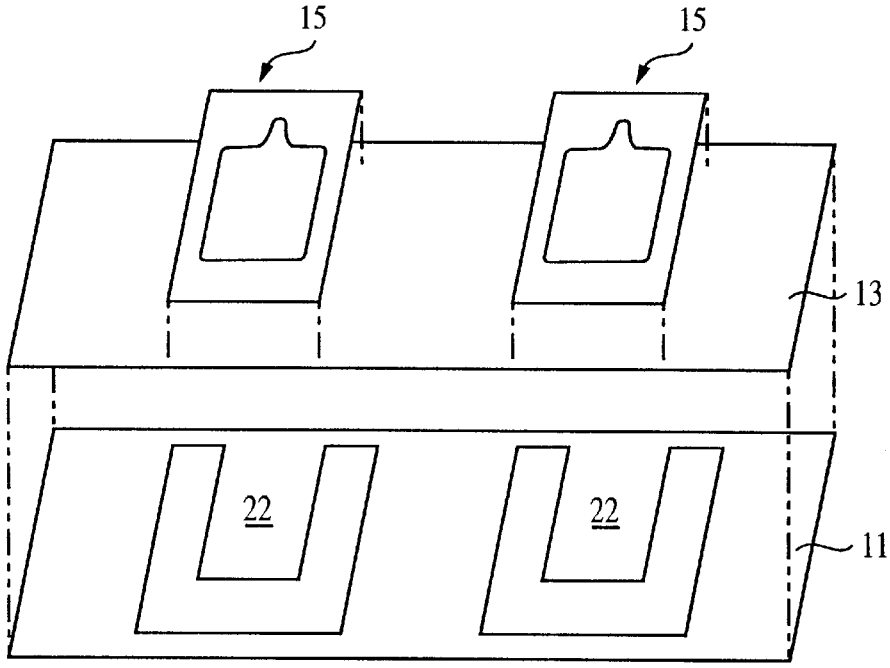
FIG. 9 shows an embodiment of a product sampler package having a plurality of sampler units in accordance with the present invention.
Figure 11:
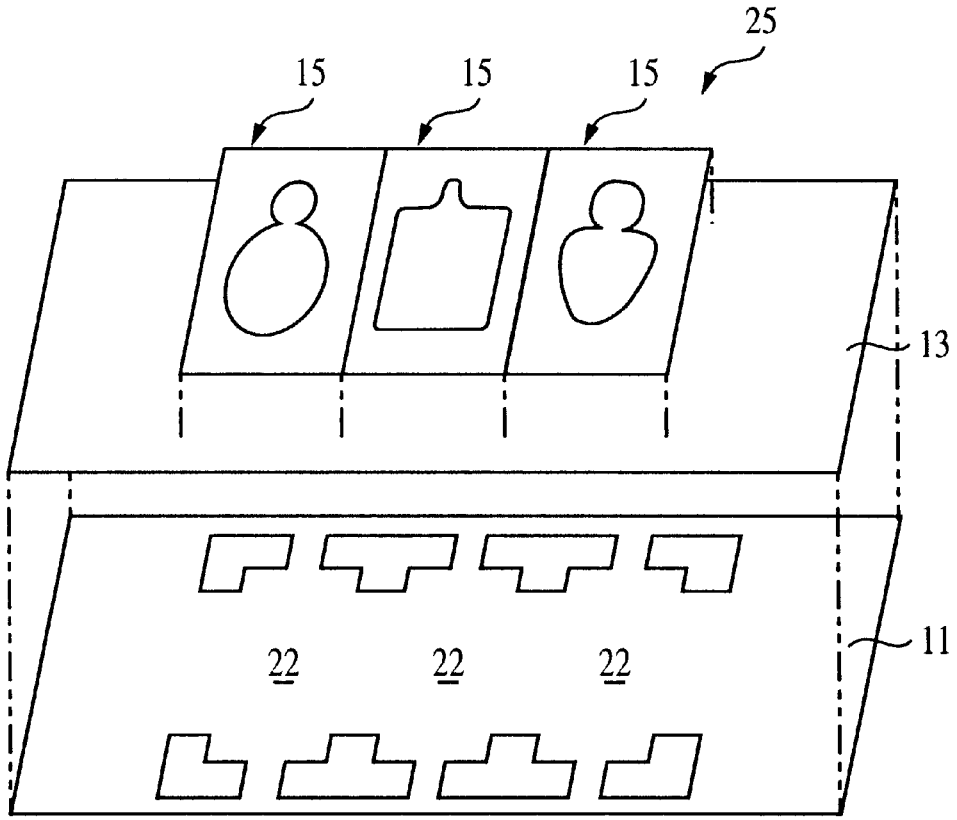
FIG. 11 shows a further embodiment of a product sampler package having a plurality of sampler units in accordance with the present invention.

When multiple product samples are to be provided with the package in the form of a sampler strip 25 as shown in FIGS. 10 and 11, the individual sampler pouches may be supported by an appropriate number of an open support frame such as that shown in FIG. 6C, or by a support frame having multiple enclosed spaces as shown in FIG. 6J for forming a corresponding number of wells 22 with the bottom sheet 11. Alternatively, if separate samplers are to be provided for each product sample, the sampler units can be spaced apart as desired and each can be supported by an individual support frame 12, as shown in FIG. 9.

Figure 12:
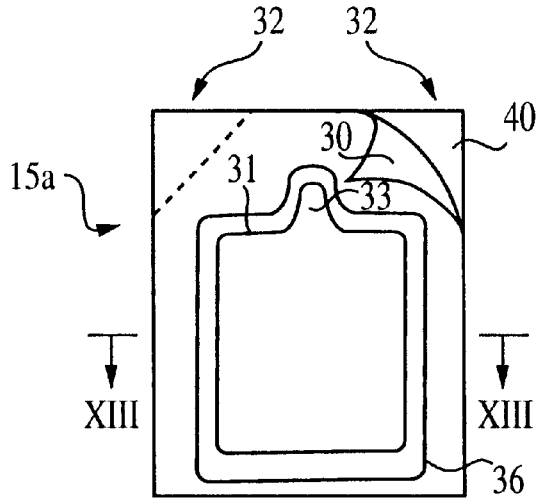
FIG. 12 shows an embodiment of a fluid sampler unit which is packaged with the composite carrier card in accordance with the present invention.
Figure 13:
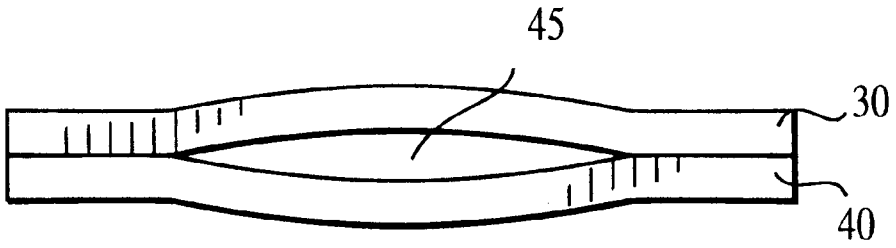
FIG. 13 is a cross-section of the fluid sampler unit cut along the line designated as XIII—XIII in FIG. 12.

One embodiment of a sampler unit used with the carrier card 10 of the present invention is shown in FIGS. 12 and 13. In this example, sampler unit 15*a* is constructed by laminating together a cover film 30 and a backing film 40 to form a pouch 31 for containing a sample of a volatile and/or liquid based product 45 such as a cosmetic, skincare, beauty, or toiletry product. Upon lamination, cover film 30 and backing film 40 are hermetically heat sealed together at all areas outside the periphery of the shape of the pouch, and leaving at least one of the upper corner regions 32 unsealed for peelable separation of the two films.

Both the cover film and the backing film are formed as composite laminates each including a barrier film layer having a moisture vapor transmission rate substantially equivalent to that of a foil film. Preferably, the cover film is transparent or translucent, or includes a transparent or translucent window 36 so that the product contained therein can be viewed without opening the sampler. If desired, both the cover film and the backing film may be transparent or translucent, or both the cover film and the backing film may contain a foil barrier layer, in which case the sampler unit will be entirely opaque.

Cover film 30 contains a transparent or translucent polymeric barrier film having a moisture vapor transmission rate (MVTR) no greater than about 0.065 g/100 in$^2$/24 hrs@100° F.,90%RH. Preferably, the barrier film has an MVTR substantially competitive with that of a film of aluminum foil and between about 0.02 to 0.04 g/100 in$^2$/24 hrs@100° F.,90%RH.

Suitable materials for the moisture vapor barrier layer include a biaxially oriented polyvinylidene chloride (biax-PVDC) film, such as BARRIALON®-UB film manufactured by Asahi Chemical Industry, Co., Ltd. and distributed by Phoenix Films, Inc.; a modified fluoropolymer film such as a polychlorotrifluoroethylene (PCTFE) film familiar to those knowledgeable in the art as ACLAR®, manufactured by Allied Signal Corp; or an aluminum oxide (AlOx) coated polyester (PE) film. Each of the biax-PVDC film, the PCTFE film, and the AlOx coated PE film have MVTR values within the desired range and are also transparent.

Cover film 30 also includes a heat seal layer to enable hermetic sealing with backing film 40. Examples of suitable materials for use as a heat seal layer include low density polyethylene (LDPE), a blend of high density and low density polyethylene, and Surlyn® (DuPont) coextrusions. In one example of the present invention, the sampler unit provides an easy opening feature which is achieved by the addition of polybutylene to the heat seal layer to render the seal between the cover film and the backing film readily separable by peeling.

Additional layers may be included in cover film 30 in accordance with various aspects of the present invention, such as additional barrier layers, and/or other films to augment the sealing layer. Each layer in cover film 30 is transparent or translucent, so as to provide a sampler package which enables viewing of the color and texture of the product to be sampled.

The various layers of cover film 30 are preferably laminated together using adhesive layers made of, for example, a polyurethane adhesive. Alternatively, the cover film layers may be coextrusion laminated using tie layers made from materials such as ethylene vinyl acetate, ethylene methacrylate or ethylene vinyl alcohol. Additional layers may be coextruded with the barrier film and may include films made of an oriented polypropylene or linear low density polyethylene.

The plurality of layers in the composite laminate forming cover film 30 further enhances the moisture barrier properties of the foil-like MVTR of the barrier film. Moreover, the composite laminate is stiff enough to provide sufficient rigidity to resist wrinkling or folding during handling, yet retains the necessary flexibility to withstand flexing without cracking or otherwise compromising its barrier qualities.

In order to define a window through which the product sample is viewed, a window design 36 and/or copy print may be printed onto either the exterior surface of the top layer of cover film 30 using any known method of printing onto a film, or onto the interior surface thereof by reverse surface printing prior to lamination with the barrier film.

Like cover film 30, backing film 40 comprises at least a barrier layer and a heat seal layer. In backing film 40, the barrier layer is preferably an aluminum foil film having a thickness at least about 0.20 mil (MVTR<0.01 g/100 in$^2$/24 hrs@100° F.,90%RH). As with the cover film, the heat seal layer may be comprised of a high density/low density polyethylene blend or other suitable material. Similarly, additional layers may be included or suitable alternative materials may be substituted as described above.

The layers forming the composite laminate of backing film 40 are preferably laminated with adhesive layers made from a material such as a polyurethane or other suitable adhesive. Alternatively, the layers of backing film 40 may be coextrusion laminated using tie layers made from materials such as LDPE, ethylene vinyl acetate, ethylene methacrylate or ethylene vinyl alcohol.

In another embodiment of the present invention, the foil film may be substituted with a transparent or translucent barrier film as used in the cover film. In this embodiment, backing film 40 has a composition substantially similar to that of cover film 30, wherein each layer is transparent or translucent. Backing film 40 may also contain a window design and/or copy print as described above with respect to cover film 30, so as to be viewable through transparent cover film 30 if the product contained therein is also transparent or translucent.

Cover film 30 and backing film 40 are sealed together to form a pouch 31. In an embodiment in which both cover film 30 and backing film 40 are transparent and translucent or are both foil-based laminates, the entire sampler can be made from one composite laminate by sealing the laminate to itself to form pouch 31. Although heat sealing is the preferred method of sealing, other sealing methods are also consistent with the present invention, such as dielectric sealing, radiant sealing, sonic sealing, high frequency sealing, etc.

Figure 14:
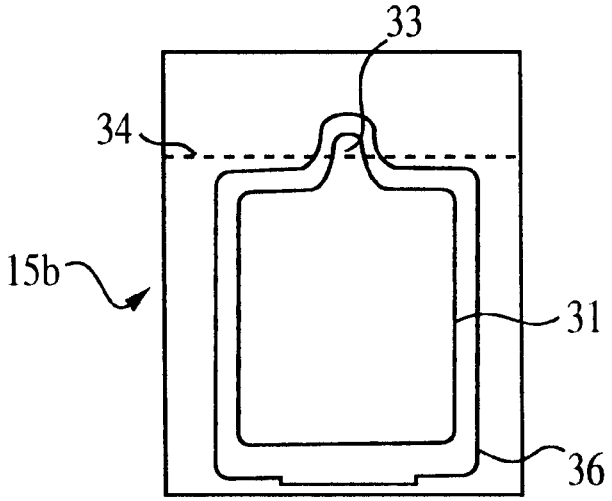
FIG. 14 shows another embodiment of a fluid sampler unit which is packaged with the composite carrier card in accordance with the present invention.

In the preferred embodiment of the invention, each pouch 31 is formed with a tip 33 at the top portion thereof, to provide a spout-like opening through which the product can be easily dispensed. To open the sampler unit, the consumer simply separates the cover film 30 from the backing film 40 at an unsealed corner of the unit, and peels the cover film back to unseal the pouch at the region of the tip 33. The product can then be applied onto the consumer's fingers or an applicator by squeezing or pressing on the main portion of the pouch 31. Instead of the peelable corner regions, the sampler unit may be provided with an alternative means for opening the pouch to access the product sample, such as by perforating the sampler unit along line 34 across tip 33 as illustrated in FIG. 14, whereby the unit can be opened by tearing along the perforated line.

Figure 15:
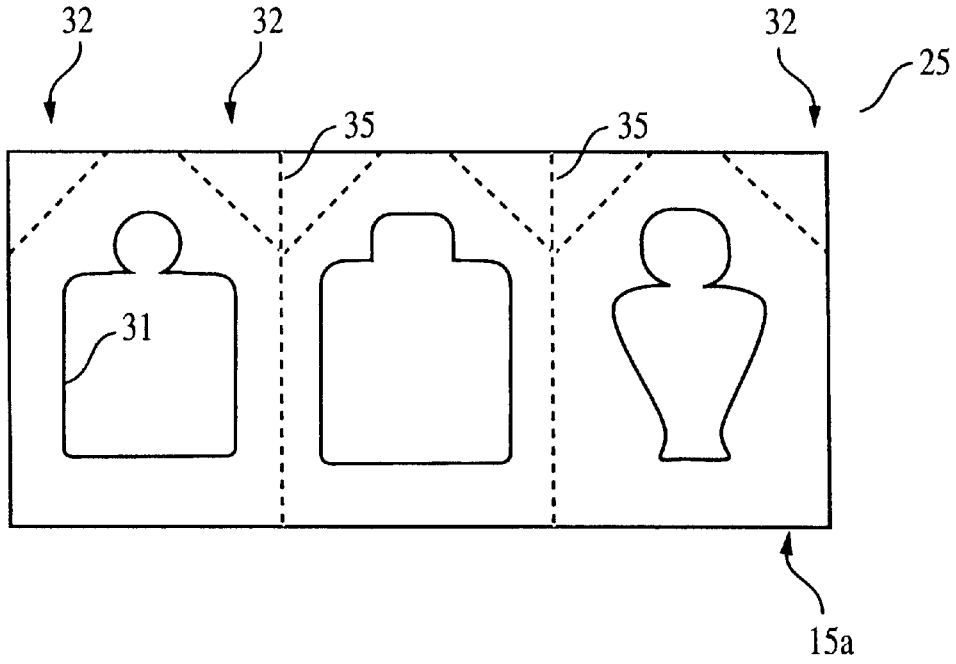
FIG. 15 shows a plurality of the fluid sampler units illustrated in FIG. 12 provided in a continuous strip.
Figure 16:
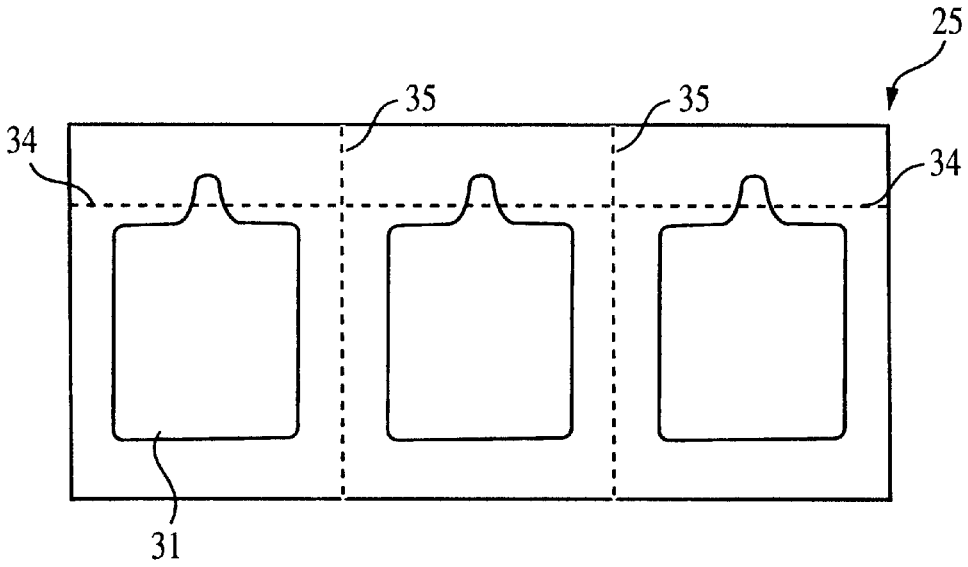
FIG. 16 shows a plurality of the fluid sampler units illustrated in FIG. 14 provided in a continuous strip.

In the embodiment of FIGS. 10 and 11, the multiple product samples are provided as a strip 25 of sampler units, shown in FIGS. 15 and 16. The individual units are separated by perforation lines 35. To sample a selected one of the displayed products, the consumer would tear along perforation 35 for a length sufficient to allow only the selected unit to be opened, either by peeling apart the cover and backing films at the selected corner 32 or by tearing along the selected perforation line 34.

In the process for forming the product samplers shown in FIGS. 12–16, a roll of the transparent composite laminate 30 and a roll of the foil barrier composite laminate 40 are fed to a die which seals together the heat seal layers of each composite laminate in a shape which partially forms a plurality of sampler pouches 31 along a continuous strip of sampler units. This initial sealing process leaves a portion of each pouch unsealed, up to approximately one-half the perimeter of a finished pouch. The roll of partially heat-sealed pouches is then sent to the next processing stage, where each pouch is placed under a nozzle which fills the cosmetic sample into the pouch. When a plurality of different types or colors of cosmetic samples are to be provided in one strip of sampler units, as in the embodiment shown in FIG. 11, a plurality of nozzles are used so that each nozzle fills a different color or product type into the respective pouch.

For distribution in magazines, mailers, or the like, each sampler unit is sized so that when filled with the fluid or volatile cosmetic and placed on a horizontal surface, the fluid volume becomes thinly dispersed across the area of the pouch to only slightly swell the volume of the pouch. By spreading the fluid volume over a relatively large surface area, the sampler can thus be constructed as a compact and non-bulky unit having a substantially flattened profile.

After filling, the unsealed perimeter of each pouch is sealed to form a continuous strip of sealed sampler units. In completing the sealing process of each pouch, the shape of each pouch is provided with an extended tip portion 33 for ease of dispensing the product upon being opened by the consumer. Also, the upper corner regions 32 of each unit is left unsealed. The roll of sealed sampler units is then perforated by die cutting through the sealed regions between the pouches along lines 35 for ease of separation of the individual units.

In making the sampler units of the embodiments shown in FIGS. 14 and 17, the corner regions of the sampler units are sealed together in the second sealing stage around the periphery of the pouch shape, whereupon the roll of sealed sampler units is also perforated by die cutting perpendicularly to perforations 35 to form perforations 34 across the tip 33 of each pouch for ease of opening.

The roll of sampler units is then cut to separate each individual unit as shown in FIGS. 12 and 14, or to form strips of sampler units, with each strip having a plurality of units as shown in FIGS. 15 and 16.

The process for assembling the package 1 will now be described below.

In the preferred embodiment, the bottom carrier sheet and the top carrier sheet are formed as one continuous sheet. Any desired text or illustrations is pre-printed onto one or both surfaces of top and bottom sheets. Any opening(s) in the top sheet and/or any perforation lines to be provided are then die cut at the appropriate locations. After die-cutting, the support frame(s) is affixed to the front surface of the bottom sheet with an adhesive, at a position which will surround the periphery of the opening when the top sheet is superimposed or folded over the bottom sheet.

Next, an adhesive is applied to the surface of support frame, and on the bottom and/or the top sheet around the perimeter along which the edges of the top sheet are to be adhered to the bottom sheet. The adhesive used for this purpose can be either a permanent or temporary adhesive or other type of adhesive, and can be a water based adhesive or a hot melt adhesive, for example.

If the coupon region is to be defined solely in one of the top sheet or the bottom sheet, then a temporary adhesive should be used to seal the top and bottom sheets together, at least in the vicinity of the coupon region, so that the coupon can be easily detached from the appropriate sheet by a consumer without destruction of the coupon. On the other hand, if the coupon region is formed from both the top and bottom sheets, then a permanent adhesive should be used to seal the two layers together. For best results, the adhesive around the perimeter region should be applied in a dot pattern to minimize leakage of the adhesive upon sealing.

Next, the unitary sheet is scored to define a fold line, and then folded along the score to bring the top sheet in contact with the bottom sheet. The seal between the top and bottom sheets with the support frame in between is secured by passing the folded card through a nip roller. Once sealed, an adhesive, preferably permanent, is applied to either the top carrier sheet at the appropriate location or to the bottom sheet through the opening, and then the sampler unit is affixed to the composite carrier card.

It is emphasized that although the product sampler package described herein is preferably used to package at least one unit of a sampler containing a fluid product, the package of the present invention can be used with a variety of product samplers not limited to the sampling of fluid products. For example, although the package 1 described hereinabove is suitable for presentation of samples of a liquid, semi-solid, paste, gel, or volatile personal care products, the present invention can also be used in connection with the presentation of solid, powder, wax-based and/or nonvolatile products.

Furthermore, the product sampler used with the present package can have various construction and shapes not necessarily limited to that of the preferred embodiment disclosed herein. Specifically, the type of sampler unit used to contain the product sample is not necessarily the pouch-type packette described above, and can be any other known type of sampler package suitable for the type of product being sampled. For example, sampler units having the product sample printed or screen printed therein may also be used in conjunction with the composite carrier card described above.

Thus, one of skill in the art can readily contemplate various modifications to the dimensions and/or the placement and structure of the specific features to accommodate a particular product sampler used therewith. Furthermore, certain features, such as the coupon region for example, may be omitted if desired.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A product sampler package comprising:

a composite carrier card including a bottom sheet, a planar support element affixed to the bottom sheet and having a thickness and configuration so as to form a well therewith, and a top sheet covering the planar support element and affixed to the bottom sheet; and a product sampler comprising a sealed compartment containing a product sample and disposed on the top sheet and affixed to the composite carrier card, such that the product sampler is supported by the support element and a substantial portion of the product contained in the sampler is substantially centered over the well, so that a significant portion of a compression force applied to the product sampler is distributed to and absorbed by the support element, thereby enhancing the burst strength of the product sampler.

2. The product sampler package as recited in claim 1, wherein the support element is structured to form a circumference around an enclosed space.

3. The product sampler package as recited in claim 1, wherein the support element has an open structure which forms the well by supporting the product sampler on at least two opposite sides.

4. The product sampler package as recited in claim 1, wherein the support element is made from a corrugated cardboard.

5. The product sampler package as recited in claim 4, wherein the support element is made from a corrugated cardboard having type N flutes.

6. The product sampler package as recited in claim 4, wherein the support element has a front surface having a same color as one of the top sheet and the bottom sheet.

7. The product sampler package as recited in claim 1, wherein the top sheet has an opening positioned over the well, and wherein the product sampler covers the opening and is affixed to the bottom sheet through the opening.

8. The product sampler as recited in claim 7, wherein the opening in the top sheet is smaller than the well.

9. The product sampler package as recited in claim 1, wherein the top and bottom sheets are defined from one sheet which has been folded along a fold line which forms one edge of the composite carrier card.

10. The product sampler package as recited in claim 1, wherein the top and bottom sheets are separate sheets, whereby the top sheet is aligned with and superimposed to the bottom sheet before being affixed to the bottom sheet.

11. The product sampler package as recited in claim 1, wherein the top sheet is the same size as the bottom sheet.

12. The product sampler package as recited in claim 1, wherein the top sheet has one of a shorter width or a shorter length than the bottom sheet while having the same dimension with the bottom sheet in the other of the width or length dimension.

13. The product sampler package as recited in claim 1, wherein the composite carrier card further includes a detachable coupon region defined by a perforated line.

14. The product sampler package as recited in claim 1, wherein the product sampler contains a product provided in the form of a liquid, cream, paste, gel, wax, volatile or non-volatile composition.

15. The product sampler package as recited in claim 14, wherein the product sampler, as supported by the support element, can withstand a load of at least 4000 lbs applied across the entire surface thereof without bursting.

16. The product sampler package as recited in claim 14, wherein the product sampler includes a hermetically sealed compartment formed from a cover film laminate sealed with a backing film laminate.

17. The product sampler package as recited in claim 16, wherein the sampler is openable by peeling apart the cover film laminate and the backing film laminate to unseal the sealed compartment.

18. The product sampler package as recited in claim 16, wherein at least one of the cover film laminate and the backing film laminate is transparent or translucent.

19. The product sampler package as recited in claim 18, wherein both the cover film laminate and the backing film laminate are transparent or translucent.

20. The product sampler package as recited in claim 16, wherein at least one of the cover film laminate and the backing film laminate has a barrier layer made from a foil film.

21. The product sampler package as recited in claim 20, wherein both the cover film laminate and the backing film laminate have barrier layers made from a foil film.

22. The product sampler package as recited in claim 16, wherein the cover film laminate is transparent and the backing film laminate is opaque, and wherein the barrier layer of the backing film laminate is made from a foil film.

23. The product sampler package as recited in claim 16, wherein each of the cover film laminate and the backing film laminate includes a barrier layer having a moisture vapor transmission rate no greater than about 0.065 g/100 $in^2$/24 hrs@100° F.,90%RH.

24. The product sampler package as recited in claim 23, wherein the barrier layer of at least one of the cover film laminate and the backing film laminate is made from a film of AlOx coated polyester.

25. The product sampler package as recited in claim 23, wherein the barrier layer of at least one of the cover film laminate and the backing film laminate is a biaxially oriented polyvinylidene chloride film.

26. The product sampler package as recited in claim 23, wherein the barrier layer of at least one of the cover film laminate and the backing film laminate is a polycholorotrifluoroethylene film.

27. The product sampler package as recited in claim 14, wherein the product sampler contains a screen printed product sample.

28. A product sampler package comprising:

a composite carrier card including a bottom sheet, at least one planar support element affixed to the bottom sheet and having a thickness and configuration so as to form a plurality of wells, and a top sheet covering the at least one planar support element and affixed to the bottom sheet; and a plurality of product sampler units disposed on the top sheet and affixed to the composite carrier card such that the plurality of product sampler units are supported by the at least one planar support element, wherein each sampler unit comprises a sealed compartment containing a product sample and is substantially centered over a respective well, so that a significant portion of a compression force applied to the product sampler is distributed to and absorbed by the support element, thereby enhancing the burst strength of the product sampler.

29. The product sampler package as recited in claim 28, wherein the top sheet has a plurality of openings corresponding in number to the number of wells, each opening being positioned over a corresponding well, and each sampler unit covers a respective opening and is affixed to the bottom sheet through the respective opening.

30. The product sampler package as recited in claim 28, wherein the plurality of product sampler units are separated from each other, and the at least one support element includes a plurality of support elements corresponding in number to the number of sampler units, such that each support element forms a corresponding well.

31. The product sampler package as recited in claim 28, wherein the plurality of product sampler units are provided in a continuous strip, and the at least one support element is one support element which is structured to form each of the plurality of wells.

32. The product sampler package as recited in claim 28, wherein the plurality of product sampler units are provided in a continuous strip, and the at least one support element includes a plurality of support elements positioned between the top and bottom sheets of the carrier card to form the plurality of wells.

33. A process for constructing a product sampler package comprising the steps of:

affixing a planar support element to a bottom portion of a carrier card so as to define a well therewith;

applying an adhesive to the surface of the support element and around at least a portion of the periphery of at least one of a top portion and the bottom portion of the carrier card;

aligning the top portion over the bottom portion so as to cover the planar support element;

adhering the top portion to the bottom portion to form a composite carrier card;

applying an adhesive to the composite carrier card;

aligning a product sampler unit over the top portion of the composite carrier card so that the product sampler unit is supported by the support element and substantially centered over the well, the product sampler unit comprising a sealed compartment containing a product sample;

affixing the product sampler unit to the composite carrier card, whereby the burst strength of the product sampler unit is enhanced by the composite carrier card.

34. The process according to claim 33, wherein the top portion and the bottom portion of the carrier card are formed from a single sheet, the process further comprises, after applying the adhesive around the periphery, scoring the single sheet between the top portion and the bottom portion to form a fold line, and wherein aligning the top portion over the bottom portion includes folding the single sheet along the fold line.

35. The process according to claim 33, further comprising the step of cutting a top portion of the carrier card to form an opening therethrough, wherein the top portion is aligned over the bottom portion so that the opening in the top portion opposes the well defined by the support element affixed on the bottom portion, the product sampler unit is aligned over the top portion so as to at least substantially cover the opening, and the product sampler unit is affixed to the bottom portion through the opening.

36. The process according to claim 33, wherein the step of adhering the top portion to the bottom portion includes passing the composite carrier card through a nip roller.

37. The process according to claim 33, further including the step of perforating at least one of the top portion and bottom portion of the carrier card to form a detachable coupon region.

* * * * *